US006964180B1

(12) United States Patent
Shivers, III

(10) Patent No.: US 6,964,180 B1
(45) Date of Patent: Nov. 15, 2005

(54) METHOD AND SYSTEM FOR LOADING PRESSURIZED COMPRESSED NATURAL GAS ON A FLOATING VESSEL

(75) Inventor: Robert Magee Shivers, III, Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 0 days.

(21) Appl. No.: 10/903,447

(22) Filed: Jul. 30, 2004

Related U.S. Application Data

(60) Provisional application No. 60/510,467, filed on Oct. 13, 2003.

(51) Int. Cl.[7] ..... F25J 1/00
(52) U.S. Cl. ..... 62/611; 62/613; 62/616
(58) Field of Search ..... 62/611, 613, 614, 62/616, 115, 304

(56) References Cited

U.S. PATENT DOCUMENTS 6,041,619 A * 3/2000 Fischer et al. ..... 62/612
6,308,531 B1 * 10/2001 Roberts et al. ..... 62/611
6,389,844 B1 * 5/2002 Klein Nagel Voort ..... 62/612
6,598,423 B1 * 7/2003 Emmer et al. ..... 62/614
6,655,155 B2 * 12/2003 Bishop ..... 62/45.1
6,658,891 B2 * 12/2003 Reijnen et al. ..... 62/612
6,735,979 B2 * 5/2004 Lecomte et al. ..... 62/611
6,751,985 B2 * 6/2004 Kimble et al. ..... 62/613
6,763,680 B2 * 7/2004 Fischer et al. ..... 62/612
6,782,714 B2 * 8/2004 Iijima et al. ..... 62/611
6,789,394 B2 * 9/2004 Elion et al. ..... 62/612
6,810,924 B2 * 11/2004 White ..... 141/82
6,889,522 B2 * 5/2005 Prible et al. ..... 62/611

* cited by examiner

*Primary Examiner*—Mohammad M. Ali
(74) *Attorney, Agent, or Firm*—Buskop Law Group, P.C.; Wendy Buskop

(57) ABSTRACT

The method for loading pressurized compressed natural gas into a storage element on a floating vessel entails introducing compressed natural gas from a source into a storage element located on the floating vessel raising the storage element pressure from about 800 psi to about 1200 psi at an ambient temperature; allowing a portion of the compressed natural gas to cool forming a liquid in the storage element; removing remaining vapor phase compressed natural gas from the storage element to a refrigeration plant, wherein the refrigeration plant is adapted to cool the vapor; removing the liquid from the storage element to the refrigeration plant; wherein the refrigeration plant is adapted to cool the liquid; mixing the cooled vapor phase with the cooled liquid phase and returning the mixture to the storage element; repeating the steps until the vapor has been cooled and is substantially a liquid.

11 Claims, 2 Drawing Sheets

METHOD AND SYSTEM FOR LOADING PRESSURIZED COMPRESSED NATURAL GAS ON A FLOATING VESSEL

The present application claims priority to co-pending U.S. Provisional Patent Application Ser. No. 60/510,467 filed on Oct. 13, 2003.

FIELD

The application relates to a method for loading pressurized compressed natural gas into a storage element and into a series of storage elements on a floating vessel for transport.

BACKGROUND

The current art teaches three known methods of transporting natural gas across bodies of water. A first method is by way of subsea pipeline. A second method is by way of ship transport as liquefied natural gas (LNG). A third method is by way of barge, or above deck on a ship, as compressed natural gas (CNG). Each method has its inherent advantages and disadvantages.

Subsea pipeline technology is well known for water depths of less than 1000 feet. The cost of deep water subsea pipelines is very high and methods of repairing and maintaining deep water subsea pipelines are just being pioneered. Transport by subsea pipeline is often not a viable option when crossing bodies of water exceeding 1000 feet in depth. A further disadvantage of subsea pipelines is that, once laid, it is impractical to relocate.

Liquefied natural gas systems, or LNG systems, require natural gas to be liquefied. This process greatly increases the fuel's density, thereby allowing a relatively few number of ships to transport large volumes of natural gas over long distances. LNG systems require a large investment for liquefaction facilities at the shipping point and for regasification facilities at the delivery point. In many cases, the capital cost of constructing LNG facilities is too high to make LNG a viable option. In other instances, the political risk at the delivery and/or supply point may make expensive LNG facilities unacceptable. A further disadvantage of LNG is that even on short routes, where only one or two LNG ships are required, the transportation economics are still burdened by the high cost of full shore facilities. The shortcoming of a LNG transport system is the high cost of the shore facilities which, on short distance routes, becomes an overwhelming portion of the capital cost.

Natural gas prices are increasing rapidly due to an inability to meet demand. Unfortunately, the LNG import terminals existing in the United States are presently operating at capacity. New import terminals of the type currently used in the United States cost hundreds of millions of dollars to build. Moreover, it is very difficult and expensive to find and acquire permissible sites for such facilities. Besides the space needed for the import tanks, pumps, vaporizers, etc., large impoundment safety areas must also be provided around all above-ground LNG storage and handling vessels and equipment. LNG import facilities also consume large amounts of fuel gas and/or electrical energy for pumping the LNG from storage and vaporizing the material for delivery to gas distribution systems.

Compressed natural gas, or CNG, can be transported by way of barge or above deck on a ship. For the method to work, the CNG is cooled to a temperature around −75 degrees Fahrenheit at a pressure of around 1150 psi. The CNG is placed into pressure vessels contained within an insulated cargo hold of a ship. Cargo refrigeration facilities are not usually provided aboard the ship. A disadvantage of this system is the requirement for connecting and disconnecting the barges into the shuttles, which takes time and reduces efficiency. Further disadvantages include the limited seaworthiness of the multi-barge shuttles and the complicated mating systems that adversely affect reliability and increase costs. In addition, barge systems are unreliable in heavy seas. Finally, current CNG systems have the problem of dealing with the inevitable expansion of gas in a safe manner as the gas warms during transport.

The amount of equipment and the complexity of the inter-connection of the manifolding and valving systems in the barge gas transportation system bears a direct relation to the number of individual cylinders carried onboard the barge. Accordingly, a significant expense is associated with the manifolding and valving in connecting the gas cylinders. Thus, the need has arisen to find a storage system for compressed natural gas that can both contain larger quantities of compressed natural gas and simplify the system of complex manifolds and valves.

A need exists for a method to transfer compressed natural gas across heavy seas to locations greater than 500 nautical miles. Such a method would require the use of storage elements, specifically designed to hold CNG and deal with expansion due to warming.

A method is, therefore, needed to deal with loading pressurized compressed natural gas into a storage element and into a series of storage elements on a floating vessel for transport.

SUMMARY

An embodiment of the application is a method for loading pressurized compressed natural gas into a storage element on a floating vessel. The method begins by introducing compressed natural gas from a source into a storage element located on a floating vessel raising the storage element pressure to about 800 psi to about 1200 psi and at an ambient temperature and, then, allowing a portion of the compressed natural gas to cool forming a liquid in the storage element.

The method continues by removing remaining vapor phase compressed natural gas from the storage element to a refrigeration plant, wherein the refrigeration plant is adapted to cool the vapor; removing the liquid from the storage element to the refrigeration plant; wherein the refrigeration plant is adapted to cool the liquid; and mixing the cooled vapor phase with the cooled liquid phase and returning the mixture to the storage element. These three steps are repeated until the vapor has been cooled and is substantially a liquid.

An embodiment of the application is a system for loading pressurized compressed natural gas into a storage element on a floating vessel. The system is a source of compressed natural gas, one or more storage elements on a floating vessel, a gas compressor to transfer gas, and a liquefaction plant.

BRIEF DESCRIPTION OF THE DRAWINGS

The present method will be explained in greater detail with reference to the appended Figures, in which.

The present method is detailed below with reference to the listed Figures.

DETAILED DESCRIPTION OF THE PREFERRED EMBODIMENTS

Before explaining the present method in detail, it is to be understood that the method is not limited to the particular embodiments herein and it can be practiced or carried out in various ways.

With reference to the figures, an embodiment is a method for loading pressurized compressed natural gas into a storage element on a floating vessel.

Figure 1:
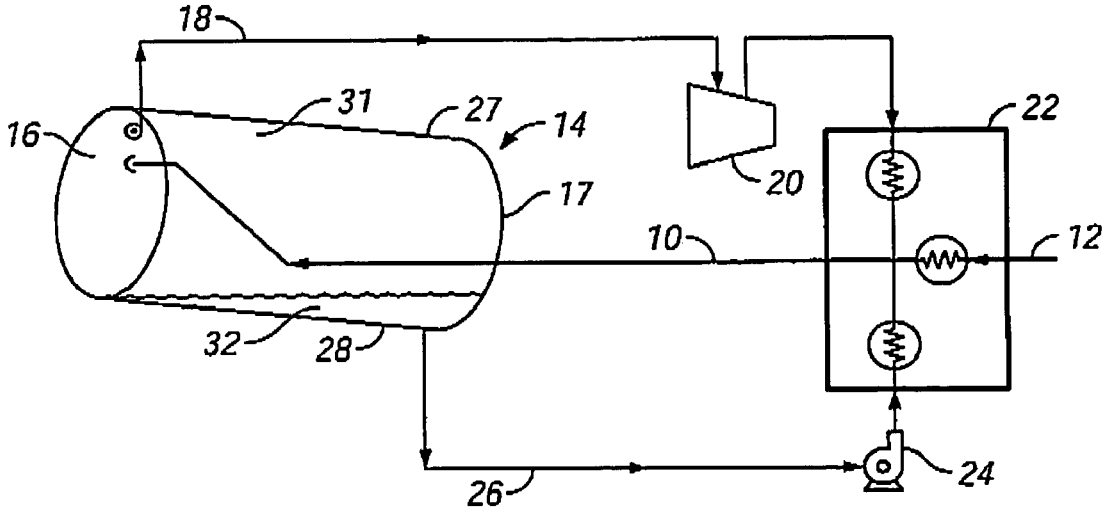
FIG. 1 depicts a vessel cooling system in the initial stage wherein the storage element is charged to system operating temperature.

Referring to FIG. 1, compressed natural gas 10 enters from a source 12 into a storage element 14 that is at a low pressure, preferably between about 50 psi and about 250 psi.

The storage element 14 is preferably a double walled cylinder with an inner wall pressure containing shell and an outer protective shell with insulation in the annular area between the two shells. In a preferred embodiment, the insulation is perlite. The inner wall can sustain between about 800 psi and about 1200 psi of pressure. The inner wall is constructed of a load-bearing ferrous material, such as steel, cast iron, wrought iron, or other such materials.

In a preferred embodiment, the storage element is inclined at a slight angle due to ballasting a ship or mounting the element on an angle in a cradle. Inclining the storage element causes the first end 16 of the storage element to be higher than the second end 17 so the liquids in the storage element can flow out of the element easier.

Continuing with FIG. 1, the storage element is then charged up to the system operating pressure. The system operating pressure usually ranges between about 800 psi and about 1200 psi.

Gas vapor is conveyed from a source 12 to the first end 16 of the storage element. Some vapor condenses and some does not. The vapor that did not condense flows from the top end 27 of the storage element by a vapor phase recycle line 18. A portion of the vapor expands and cools as it enters the low pressure storage element. As the vapor cools, the vapor condenses and falls to the bottom 28 of the storage element as a liquid phase.

As seen in FIG. 1, a compressor 20 is preferably used to move the gas vapor from the storage element to a refrigeration plant 22. The vapor is slightly compressed. The compression raises the pressure of the gas vapor to overcome the pressure lost from circulating the vapor. Preferably, the pressure lost due to circulating the vapor is less than 50 psi, but more preferably less than 20 psi.

A pump 24 is used to flow liquid from the bottom end 28 of the second end 17 of the storage element to a liquid phase recycle line 26 and then to the refrigeration plant 22. The pump 24 raises the pressure slightly in the liquid phase recycle line to overcome the pressure lost from recycling.

In the refrigeration plant, the vapor from the vapor line 18 is cooled. The liquid from the recycle line 26 is also cooled. The cooled vapor and cooled liquid are mixed together and returned to the container through the gas inlet line 10.

Figure 2:
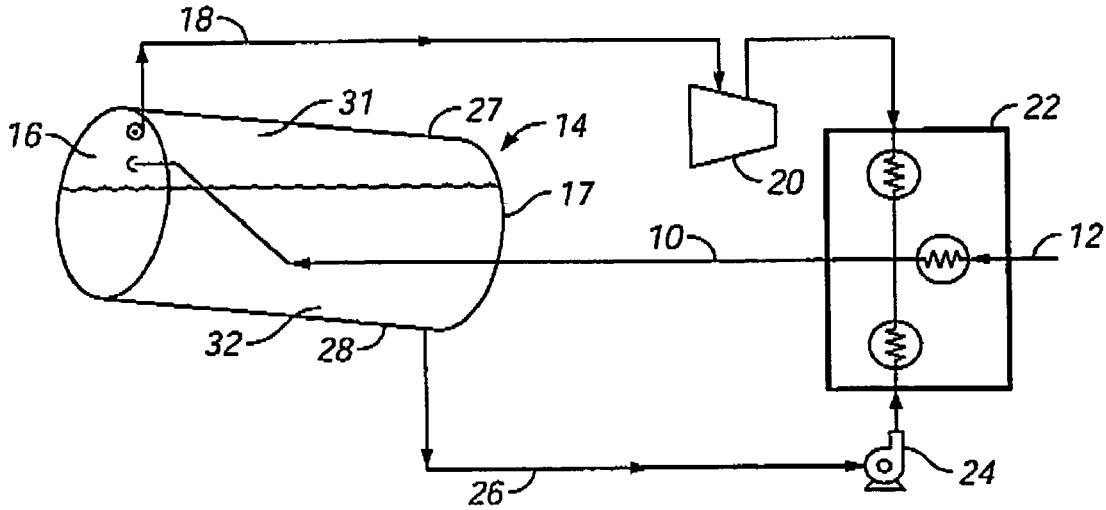
FIG. 2 depicts the final stage of the vessel cooling system.

FIG. 2 depicts an embodiment wherein the storage element accumulates liquid 32 in the storage element 14. Vapor in the storage element is depicted in FIG. 2 as reference numeral 31.

The source of the compressed natural gas can be based on a land facility, a floating facility, a platform facility, or combinations thereof.

The floating vessel comprises a deck and the storage element is mounted on the deck. In an alternative embodiment, the method involves ballasting the floating vessel on one end in order to orientate the storage element on an incline.

Like the source, the refrigeration plant can also be based on a land facility, a floating facility, a platform facility, or combinations thereof.

Figure 3:
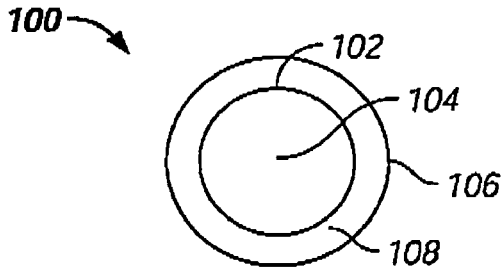
FIG. 3 depicts a storage element used in the invention.

FIG. 3 depicts a cross-sectional view of the storage element used in the method. Preferably, the storage element is a double-walled tubular member. The cross-sectional view shows the storage element as cylindrical 100. The storage element 100 has with an inner load bearing wall 102, an outer wall 106, and an insulating layer 108. The area within the inner load bearing wall is a storage area 104 that contains the compressed natural gas in both the liquid and vapor phases.

The inner load bearing wall 102 is constructed of a low-alloy steel comprising about 3.5 wt % or less of nickel. The low-alloy steel improves tensile strength of the inner load bearing wall to about 115 ksi or less. In addition, the inner load bearing wall 102 has a diameter ranging from about 8 feet to about 15 feet and a wall thickness of ranging from about 1 inch to about 2 inches.

The outer wall is made of steel, stainless steel, aluminum, thermoplastic, fiberglass, or combinations thereof. The outer wall has a diameter that is up to four feet larger in diameter than the inner wall. The insulating layer made of perlite, but other insulating substances can be used.

Figure 4:
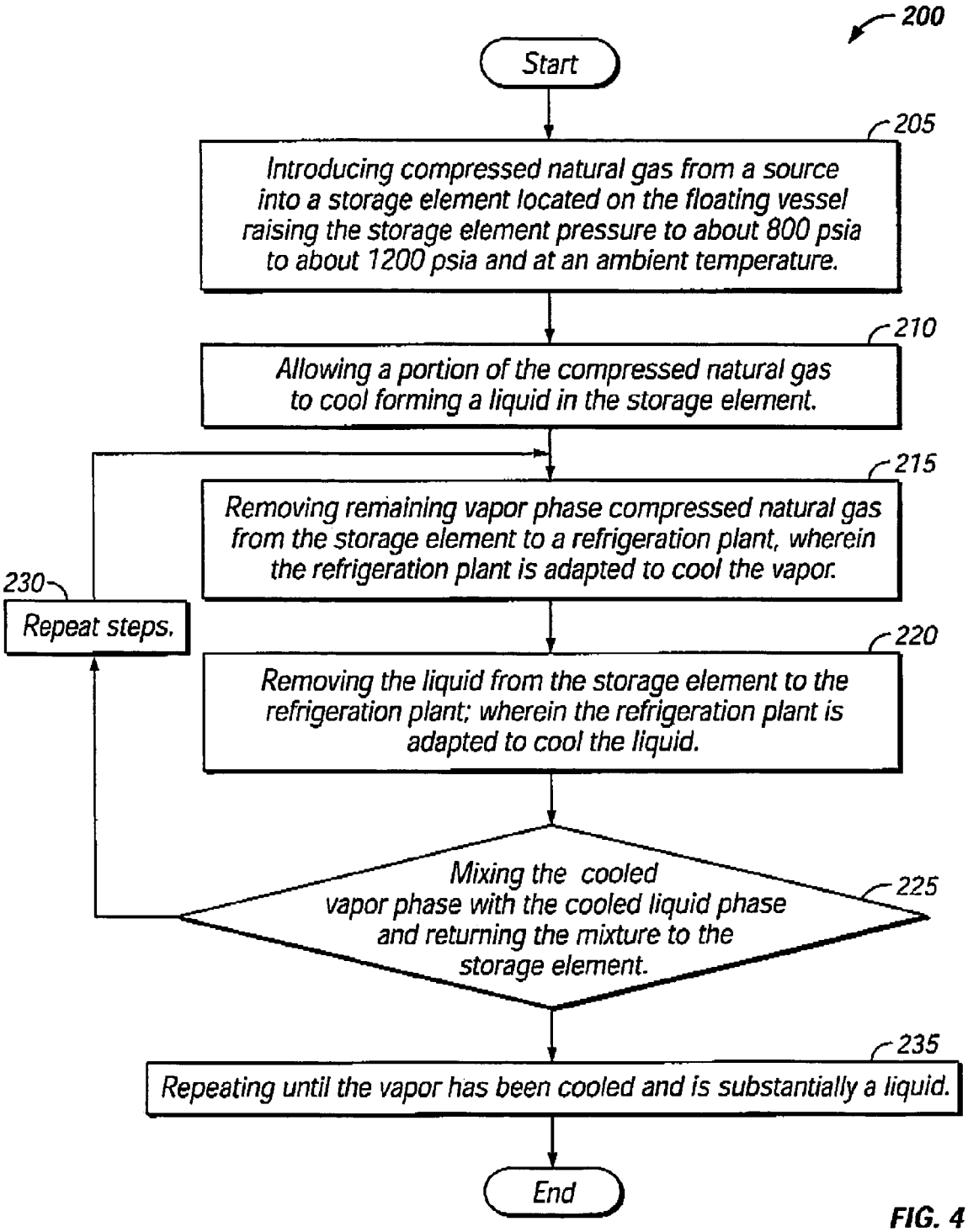
FIG. 4 is a schematic of the method for loading pressurized compressed natural gas into a storage element on a floating vessel.

A schematic of the method is depicted in FIG. 4. The method 200 is for loading pressurized compressed natural gas into a storage element on a floating vessel.

The method begins by introducing compressed natural gas from a source into a storage element located on the floating vessel 205. The pressure in the storage element is raised to about 800 psi to about 1200 psi at an ambient temperature.

The method continues by allowing a portion of the compressed natural gas to cool forming a liquid in the storage element 210 and removing remaining vapor phase compressed natural gas from the storage element to a refrigeration plant, wherein the refrigeration plant is adapted to cool the vapor 215.

The liquid is removed from the storage element and sent to the refrigeration plant 220. The refrigeration plant is adapted to cool the liquid.

Continuing with FIG. 4, the method next involves mixing the cooled vapor phase with the cooled liquid phase and returning the mixture to the storage element 225.

The steps are repeated by recycling the incoming compressed natural gas and the vapor phase from the storage element to the refrigeration plant and back to the storage element 230. The method ends when the vapor has been cooled and is substantially a liquid 235.

The method can be used with a plurality of storage elements. The elements could be connected in series. The storage elements can also be connected in parallel.

While this method has been described with emphasis on the preferred embodiments, it should be understood that within the scope of the appended claims the method might be practiced or carried out in various ways other than as specifically described herein.

What is claimed:

1. A method for loading pressurized compressed natural gas into a storage element on a floating vessel comprising the steps of:

a. introducing compressed natural gas from a source into a storage element located on the floating vessel raising the storage element pressure to about 800 psi to about 1200 psi at an ambient temperature;

b. allowing a portion of the compressed natural gas to cool forming a liquid in the storage element;

c. removing remaining vapor phase compressed natural gas from the storage element to a refrigeration plant, wherein the refrigeration plant is adapted to cool the vapor;

d. removing the liquid from the storage element to the refrigeration plant; wherein the refrigeration plant is adapted to cool the liquid;

e. mixing the cooled vapor phase with the cooled liquid phase and returning the mixture to the storage element; and f. repeating steps (c) through (e) until the vapor has been cooled and is substantially a liquid.

2. The method of claim 1, further comprising the step of ballasting the floating vessel on one end in order to orientate the storage element on an incline.

3. The method of claim 1, wherein the source is located on a land-based facility, a floating facility, a platform-based facility, or combinations thereof.

4. The method of claim 1, wherein the refrigeration plant is located on a land-based facility, a floating facility, a platform-based facility, or combinations thereof.

5. The method of claim 1, wherein the step of flowing the vapor mixture from the storage element to the refrigeration plant is completed using a gas compressor.

6. The method of claim 1, wherein the storage element is a double-walled tubular member comprising an inner load bearing wall, an outer wall, and an insulating layer.

7. The method of claim 6, wherein the inner load bearing wall is constructed of a low-alloy steel comprising about 3.5 wt % or less of nickel, wherein the low-alloy steel improves tensile strength of the inner load bearing wall to 115 ksi or less.

8. The method of claim 6, wherein the inner load bearing wall comprises a diameter ranging from about 8 feet to about 15 feet.

9. The method of claim 6, wherein the outer wall is a steel, stainless steel, an aluminum, a thermoplastic, a fiberglass, or combinations thereof.

10. The method of claim 6, wherein the outer wall comprises a diameter that is up to four feet larger in diameter than the inner wall.

11. The method of claim 6, wherein the insulating layer is perlite.

* * * * *